US009790008B2

(12) United States Patent
Martinez Carregui et al.

(10) Patent No.: US 9,790,008 B2
(45) Date of Patent: Oct. 17, 2017

(54) MULTI-FLOW PLUG

(71) Applicant: Borges Branded Foods SLU, Tarrega (ES)

(72) Inventors: Alberto Martinez Carregui, Valencia (ES); Jose Garcia Zaragoza, Valencia (ES)

(73) Assignee: Borges Branded Foods SLU (ES)

( * ) Notice: Subject to any disclaimer, the term of this patent is extended or adjusted under 35 U.S.C. 154(b) by 0 days.

(21) Appl. No.: 15/374,211

(22) Filed: Dec. 9, 2016

(65) Prior Publication Data

US 2017/0088320 A1 Mar. 30, 2017

Related U.S. Application Data

(63) Continuation-in-part of application No. 14/442,060, filed as application No. PCT/ES2013/000254 on Nov. 12, 2013, now Pat. No. 9,669,970, application No. 15/374,211, which is a continuation of application No. PCT/ES2016/070385, filed on May 20, 2016.

(30) Foreign Application Priority Data

Nov. 13, 2012 (ES) ..... 201201029 U

(51) Int. Cl.
*B65D 47/40* (2006.01)
*B65D 39/08* (2006.01)
*B65D 51/24* (2006.01)
*B65D 47/04* (2006.01)

(52) U.S. Cl.
CPC ..... *B65D 47/40* (2013.01); *B65D 39/08* (2013.01); *B65D 47/043* (2013.01); *B65D 51/245* (2013.01)

(58) Field of Classification Search
CPC ..... B65D 47/043; B65D 47/32; B65D 47/20
USPC ..... 222/567–570, 481.5, 49, 547, 482
See application file for complete search history.

(56) References Cited

U.S. PATENT DOCUMENTS

| | | | |
|---|---|---|---|
| 5,850,944 | A | 12/1998 | Robbins, III et al. |
| 2006/0108382 | A1 | 5/2006 | Migliore |

FOREIGN PATENT DOCUMENTS

| | | | |
|---|---|---|---|
| DE | 8118787 | U1 | 7/1982 |
| JP | 2003052513 | A | 2/2003 |
| JP | 2006103706 | A | 4/2006 |

*Primary Examiner* — Donnell Long
(74) *Attorney, Agent, or Firm* — St. Onge Steward Johnston & Reens, LLC

(57) ABSTRACT

A plug formed with a cylindrical body having at its bottom side a horizontal partition with a diametrical slit connecting two different surface holes located at the ends of the mentioned horizontal partition, and a mechanism for fixation to the container. The top of the plug has a pouring area formed by a circular section with an outwardly projected rim. The plug is suitable for use by blind people.

9 Claims, 2 Drawing Sheets

MULTI-FLOW PLUG

FIELD OF THE INVENTION

The present invention discloses a multi-flow plug where the pouring area is a circular section with an outwardly projected rim. The plug is suitable for use by blind people. The plug is suitable for pouring oils and slurries.

BACKGROUND OF THE INVENTION

The document considered as the closest to the present invention describes a multi-flow plug comprising of a horizontal partition provided with a diametrical slit connecting two holes with different surface sizes. The plug described in PCT/ES2013000254 shows two U-shaped paths of grooves with different radii. The device disclosed by PCT/ES2013000254 allows that two liquid flow rates to be obtained. However, when used, it is necessary to tilt the container by the grooved paths. If the container is not inclined by the grooved paths, the liquid will drip and stain the container external surface.

The above situation occurs when the user does not notice where the grooved paths are positioned, when the container is used in low visibility conditions or when used by blind people.

Another problem of the plug described in PCT/ES2013000254 is that the outline of the pouring area is not a circle due to the presence of the U-shaped grooved paths. The irregular outline does not allow the use of standardized circular caps.

On the other hand, it is common to use sauces or vinaigrettes, these consisting of slurries having a liquid phase (oils, vinegars, wines . . . ) and a solid phase (species, aromatic herbs . . . ) that is soaked in the liquid phase. When the above slurries are poured through the plugs described in the prior art along with the liquid phase, species will drop and there are some situations where it is not desired the species to drop, for example when an oil and cayenne seeds slurry is poured.

SUMMARY OF THE INVENTION

The problem solved by the present invention is to provide a suitable plug for use by the blind people. The solution found by the inventors is a plug where the pouring area is a circle with an outwardly projected rim. The plug allows the liquid contained in the container to be poured without a dropping occurs, without staining the exterior of the container, regardless of the orientation of the bottle during the pouring.

In a preferred mode, another problem solved by the invention is to improve the flow of fluid when poured through the hole with lesser surface. The solution found by the inventors is that the lesser hole has a surface between 4-12 mm2. If the surface of the hole is less than 4 mm2 the pouring flow will be intermittent while if the surface of the hole with a smaller surface is greater than 12 mm2 it will not be possible to control the amount of discharged liquid.

When the lesser hole has an area between 4-12 mm2, the plug is suitable for pouring slurries and/or vinaigrettes. If one does not desires the species to drop, the liquid is poured through the hole of smaller area as the surface of the hole is smaller than the size of the species (cayenne, peppercorns).

If one desires the species to drop, then the liquid is poured through the larger hole so that the species are allowed to drop.

In a more preferred embodiment, another problem solved by the present invention is to indicate where the holes with larger and lesser surface are located. The solution found by the inventors consists of including differently sized tactile identification means.

DETAILED DESCRIPTION OF THE INVENTION

Figure 1:
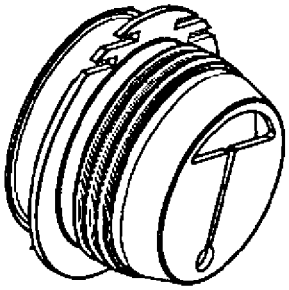
FIG. 1 shows an isometric view of the plug
Figure 2:
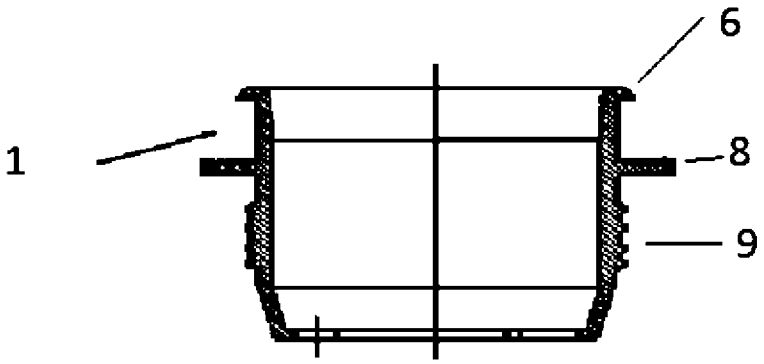
FIG. 2 shows a cross section of the plug
Figure 3:
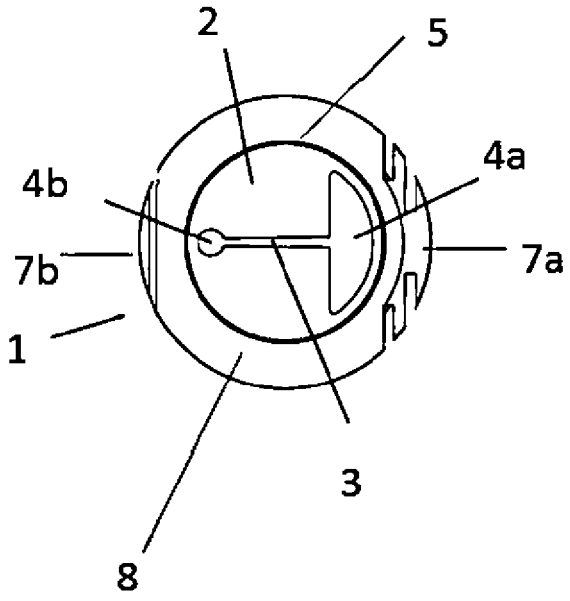
FIG. 3 shows a zenithal view of the plug.

The plug (1) described herein consists of a cylindrical body, which at its bottom side has a horizontal partition (2). The horizontal partition (2) presents a diametrical slit (3) that connects two holes (4*a*, 4*b*) with different surface holes sizes. As shown in FIG. 3 the holes (4*a*, 4 *b*) are located at the ends of the horizontal partition (2). Thus, the accumulation of poured product on the horizontal partition (2) is avoided.

The upper end of the plug has a circular section (5) and an outwardly projected rim (6) that prevents a dripping of the liquid.

The plug has at its lesser end (9) means for fixing the plug to the container, for example by threading or pressure.

With the purpose that the blind people may locate the pouring holes, the plug comprises tactile identification means of different sizes aligned with the holes. These means, in a preferred mode, are located in a peripheral skirt (8) in order to facilitate the location thereof by the blind people. In the event that the holes (4*a* and 4*b*) were not located at the ends of the horizontal partition (2), some liquid would accumulate on the partition (2) when using the plug.

The tactile identification means may be grooves, roughened surfaces, splines, dots with different height or varying numbers of raised dots. Likewise, the tactile identification means may be written in Braille.

In a preferred mode as described in the figures, the fixation of the plug to a container is performed by a thread terminating in a peripheral skirt (8) which acts as a stop. The peripheral skirt (8) comprises slits (7*a*) and splines (7*b*) as the means for tactile identification. The slits (7) are aligned with the larger surface hole (4) and the splines (7*b*) are aligned with the lesser surface hole (4*b*) as shown in FIG. 3, where the slits (7*a*) are larger than splines (7*b*) in size.

In a preferred embodiment, the lesser surface hole (4*b*) is a circle with a 1.2 mm radius leading to a 4.5 mm2 surface. The orifice allows for a constant flow of oil to be obtained, with a density of 0.9 g/ml and a surface tension of 0.033 N/m.

The plug described with a 1.25 mm radius is used to pour slurry of oil and cayenne seeds, garlic cloves or peppercorns. When the slurry is poured through the hole with the lesser surface only oil fell through, whereas when the slurry was poured through the hole with the larger surface oil and species fell through. In anyone of both situations, there was no accumulation of oil or species on the horizontal partition.

The invention claimed is:

1. A plug formed by a cylindrical body comprising:

in a bottom side thereof:

a horizontal partition with a diametrical slit connecting two holes with different sizes, a first one of said holes located at a first end of the horizontal partition a second one of said holes located at a second end of the horizontal partition, a fixation structure configured to fix the plug to a container, in a top side:

a pouring area, wherein the pouring area is a circular section with an outwardly projected rim.

2. A plug according to claim 1, wherein the smaller of the holes has an area between 4-12 square millimeters.

3. A plug according to claim 2, wherein an outer surface of the plug has different sized tactile identifying structures aligned with the holes.

4. A plug according to claim 3 wherein the tactile identifying structures are located in a peripheral skirt where the tactile identifying structures are:

slits aligned with the larger of the holes, and splines aligned with the smaller of the holes.

5. A plug according to claim 4, wherein the fixation structure consists of a thread and the peripheral skirt which acts as a stop.

6. A plug according to claim 1, wherein an outer surface of the plug has different sized tactile identifying structures aligned with the holes.

7. A plug according to claim 6, wherein the tactile identifying structures are located in a peripheral skirt, where the tactile identifying structures are:

slits aligned with the larger of the holes, and splines aligned with the smaller of the holes.

8. A plug according to claim 7, wherein the fixation structure consists of a thread and the peripheral skirt which acts as a stop.

9. A plug according to claim 1, wherein the fixation structure comprises a peripheral skirt which acts as a stop.

* * * * *